US007400838B2

(12) United States Patent
Aratake et al.

(10) Patent No.: US 7,400,838 B2
(45) Date of Patent: Jul. 15, 2008

(54) IMAGE FORMING APPARATUS WITH TONER CONCENTRATION DETECTION UNIT

(75) Inventors: Masayuki Aratake, Kanagawa (JP); Naoya Yamasaki, Kanagawa (JP); Shunichiro Shishikura, Kanagawa (JP); Shigeru Tsukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 11/354,009

(22) Filed: Feb. 15, 2006

(65) Prior Publication Data

US 2007/0053702 A1 Mar. 8, 2007

(30) Foreign Application Priority Data

Sep. 2, 2005 (JP) ..... P2005-254658

(51) Int. Cl.
*G03G 15/08* (2006.01)

(52) U.S. Cl. ..... 399/27; 399/30

(58) Field of Classification Search ..... 399/27–30, 399/58, 61, 62, 64, 227
See application file for complete search history.

(56) References Cited

FOREIGN PATENT DOCUMENTS

| | | | |
|---|---|---|---|
| JP | 04-349480 | | 12/1992 |
| JP | 05-313495 | * | 11/1993 |
| JP | 2000-029255 | A | 1/2000 |
| JP | 2001-066873 | | 3/2001 |
| JP | 2002-023434 | | 1/2002 |

* cited by examiner

*Primary Examiner*—Hoang Ngo
(74) *Attorney, Agent, or Firm*—Morgan, Lewis & Bockius LLP

(57) ABSTRACT

An image forming apparatus includes: an image carrier on which an electrostatic latent image is to be formed; a rotary development unit having a plurality of developer carriers that carry a developer used for developing the electrostatic latent image, the developer including toner, the plurality of the developer carriers being sequentially moved to a development position opposing to the image carrier, to switch a development color; and a toner concentration detection unit that detects the concentration of toner of the developer carried by one of the developer carriers located at the development position.

7 Claims, 9 Drawing Sheets

IMAGE FORMING APPARATUS WITH TONER CONCENTRATION DETECTION UNIT

BACKGROUND OF THE INVENTION

1. Field of the Invention

The present invention relates to an image forming apparatus which forms an image by means of electrophotography.

2. Description of the Related Art

Among pieces of image forming apparatus which form an image by means of electrophotography, such as a full-color copier, a printer, and a multifunction machine, one type is equipped with a rotary development unit having four development devices assigned to respective Y (yellow), H (magenta), C (cyan), and K (black) colors. In the image forming apparatus of this type, each of the development devices of the rotary development unit is provided with one development roller.

Rendering the density of an image stable has recently become important for enhancing image quality. Therefore, when a two-component developer formed from toner and a carrier is used, the concentration of toner in the developer (hereinafter simply called "toner concentration" or a "toner mixing ratio") must be appropriately controlled. Methods for detecting a toner concentration include, in addition to a method for detecting the concentration of toner in a developer agitated in a development device, a method for indirectly ascertaining the concentration of toner in the development device by means of detecting the concentration of toner in the developer carried by a development roller.

An image forming apparatus equipped with a toner concentration sensor (TC sensor) for detecting the concentration of toner on a development roller has become known as a related-art image forming apparatus having a rotary development unit. In such a conventional image forming apparatus, the concentration of toner on the development roller is detected by a toner concentration sensor. On the basis of a result of detection, supply of toner to the development apparatus from the toner cartridge is controlled. Such a system for controlling toner supply using a toner concentration sensor is also called an Auto Toner Concentration (ATC) system.

However, the related-art image forming apparatus adopts a construction for detecting the concentration of toner on a development roller through use of a toner concentration sensor and at a position differing from a position where an electrostatic latent image is actually developed (hereinafter described as a "development position"); e.g., a position displaced from the development position by 90° or 180° in the rotational direction of the rotary development unit. The apparatus suffers the following drawbacks.

Specifically, when toner supply is controlled by means of the ATC system, the concentration of toner on the development roller must first be detected at a position differing from the development position. Subsequently, the development roller must be replenished with toner after having been moved to the development position. Therefore, the image forming apparatus equipped with a rotary development unit cannot control the toner supply in real time.

SUMMARY OF THE INVENTION

The invention has been made in view of the above circumstances and provides an image forming apparatus. According to an embodiment of the invention, an image forming apparatus includes: an image carrier on which an electrostatic latent image is to be formed; a rotary development unit having a plurality of developer carriers that carry a developer used for developing the electrostatic latent image, the developer including toner, the plurality of the developer carriers being sequentially moved to a development position opposing to the image carrier, to switch a development color; and a toner concentration detection unit that detects the concentration of toner of the developer carried by one of the developer carriers located at the development position.

BRIEF DESCRIPTION OF THE DRAWINGS

Embodiment may be described in detail with reference to the accompanying drawings, in which.

DETAILED DESCRIPTION OF THE INVENTION

A specific embodiment of the present invention will be described in detail hereinbelow by reference to the drawings.

Figure 1:
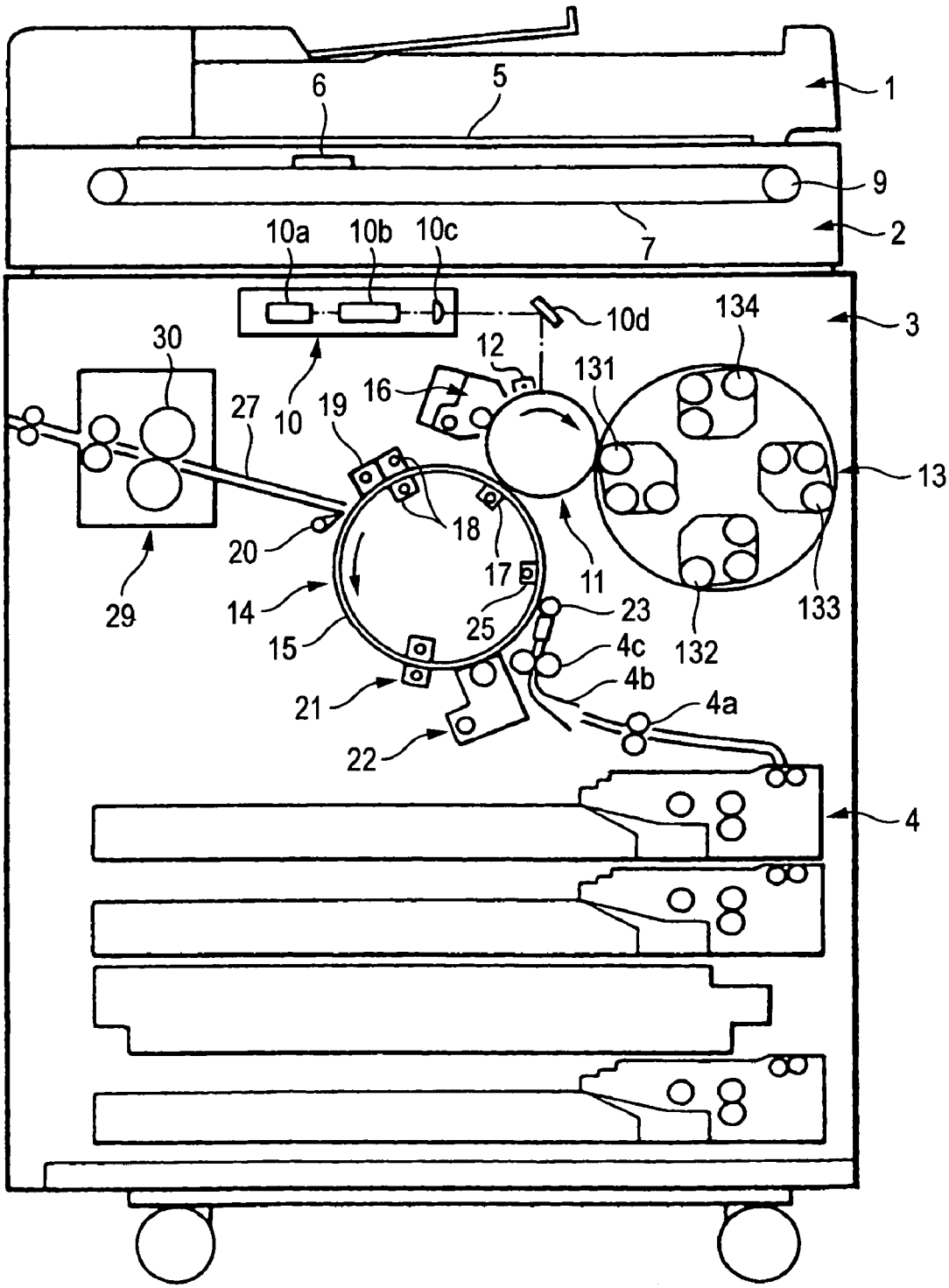
FIG. 1 is a diagrammatic view showing an example configuration of an image forming apparatus to which the present invention is applied.

FIG. 1 is a schematic diagram showing an example configuration of an image forming apparatus to which the present invention is applied. The image forming apparatus comprises, as main components, a document press unit 1 integrally provided with an automatic document feeder (ADF); a scanner section 2; a printer section 3; and a sheet tray section 4. The document press unit 1 is for pressing a document set on a document table 5 from above, and is reclosably attached to an upper portion of the main body of the scanner section 2. The document is fed to an image reading position by the ADF with the document press unit 1 being closed or placed on the document table 5 by means of a user's manual operation, which entails an action for opening and closing the document press unit 1.

The scanner section 2 comprises an optical scanning unit 6; a wire 7 for moving the optical scanning unit 6 in a sub-scanning direction (a lateral direction in FIG. 1); a drive pulley 9 for driving the wire 7; and a motor (not shown) for rotating the drive pulley 9. The optical scanning unit 6 is for optically reading and scanning an image of the original. Although not illustrated, the optical scanning unit 6 is provided with a sensor for reading an image of a document (herein after described as a "document read sensor") formed from a CCD (Charge-Coupled Device) line sensor equipped with a color filter, and a light source such as a halogen lamp, or the like, for radiating line-shaped light for image reading purpose on the surface of the document. When the image of the document is a full-color image, the color image is decomposed into B (blue), G (green), and R (red) colors, which are the primary colors of light, and the thus-decomposed color components are read by the document read sensor.

For instance, a configuration, which can be adopted as the configuration of the scanner section 2, comprises two moving-and-scanning bodies (carriages) whose moving speeds (travel distances) in the sub-scanning direction are set to a relative ratio of 1:2 on the assumption that a direction of a line in which the document read sensor performs reading operation (a direction in which pixels for reading purposes are arranged in a line) is taken as a main scanning direction and that a direction orthogonal to the main scanning direction is taken as a sub-scanning direction; optical components (a light source lamp, a light condensing mirror, a reflection mirror, and the like) provided on these two moving-and-scanning bodies; and a lens system which forms an image on a light-receiving surface of the document read sensor from the light guided by the optical components. In this case, the optical scanning unit 6 is formed from the two moving-and-scanning bodies and the optical components provided thereon. In the two moving-and-scanning bodies, a higher-speed moving-and-scanning body is also called a full-rate carriage, and a lower-speed moving-and-scanning body is also called a half-rate carriage. The full-rate carriage carries optical components, such as a light source lamp, a light condensing mirror, a full rate mirror, and the like. The half-rate carriage carries optical components such as a pair of half-rate mirrors whose mirror surfaces are arranged at right angles. Moreover, a moving system using these two carriages is also called a full-and-half-rate system.

The printer section 3 produces a print output of an image, which is an object of printing, on a sheet. The printer section 3 comprises a laser scanning unit (a laser ROS: Laser Raster output Scanner) 10 and a drum-type photosensitive body (hereinafter described as a "photosensitive drum") 11 which is to be employed as an image carrier. Disposed around the photosensitive drum 11 are an electrifying device 12 for uniformly electrifying the surface of the photosensitive drum 11; a rotary development unit 13 for developing into a toner image an electrostatic latent image written on the surface of the photosensitive drum 11 by the laser scanning unit 10; a transfer unit 14 for transferring a toner image on a sheet; and a cleaner 16 for removing from the photosensitive drum 11 residual toner, which has not been transferred to the sheet.

The photosensitive drum 11 is rotationally driven in the direction of the arrow in the drawing by means of driving operation of an unillustrated motor. At that time, the surface of the photosensitive drum 11 is uniformly electrified. The laser scanning unit 10 generates a laser beam from a laser output section 10*a*, and blinks (modulates) the laser beam in accordance with image data of respective colors output from the scanner section 2. The laser beam thus emitted from the laser output section 10*a* is radiated onto the surface of the photosensitive drum 11 by way of a polygon mirror 10*b*, an f/θ lens 10*c*, and a reflection lens 10*d*. In accordance with rotation of the polygon mirror 10*b*, the laser beam axially scans the photosensitive drum 11. Thereby, an electrostatic latent image corresponding to the image of the document read by the scanner section 2 is formed on the photosensitive drum 11.

The electrostatic latent image formed on the photosensitive drum 11 is developed into a toner image by the rotary development unit 13, and the thus-formed toner image is transferred to a sheet by the transfer unit 14. At that time, the toner (residual toner), which has not been transferred to the sheet and still remains on the photosensitive drum 11, is removed by the cleaner 16. After the surface of the photosensitive drum 11 cleansed by the cleaner 16 has again been electrified by the electrifying device 12, electrostatic latent images of other colors are sequentially written on the surface of the drum by means of driving operation of the laser scanning unit 10.

The rotary development unit 13 is rotationally driven in a clockwise direction by means of an unillustrated motor, and four development rollers 131 to 134 are provided along a rotational pathway of the rotary development unit 13. Each of the development rollers 131 to 134 rotates while an outer circumferential surface thereof is carrying a developer. The development roller corresponds to a "developer carrier" of the present invention. Each of the development rollers 131 to 134 is formed from an unillustrated magnet roller and a development sleeve. The term "rotational pathway" of the rotary development unit 13 refers to a circular path followed by an outer circumferential portion of the rotary development unit 13 when the rotary development unit 13 is rotated by driving operation of the motor.

The rotational operating angle of the rotary development unit 13 is controlled by, e.g., the following configuration. Specifically, there is realized a configuration where a slit (notched) rotor plate is attached to the rotary shaft of the rotary development unit 13; where a light-emitting section and a light-receiving section of a transmission light sensor are disposed such that the slits of the rotor plate are sandwiched between the light-emitting section and the light-receiving section; and where, every time the rotary development unit 13 rotates one turn, a sensor signal is output once from the transmission light sensor at a given rotational angle. Alternatively, there is realized another configuration which adopts a pulse motor as a motor for rotationally driving the rotary development unit 13; where rotation and stoppage of the rotary development unit 13 are controlled by supply and halt of a drive pulse to the rotational drive motor; and where the rotational angle of the rotary development unit 13 is controlled by the number of drive pulses supplied to the rotational drive motor. The rotational angle at which the rotary development unit 13 is stopped is controlled with reference to timing at which the transmission optical sensor outputs a sensor signal, by means of counting a drive pulse supplied to the rotational drive motor from this reference timing.

Provided that the sequence of colors into which a full color image is formed is set to yellow, magenta, cyan, and black, the development roller 131, among the four development rollers 131 to 134 sequentially arranged along the rotational pathway of the rotary development unit 13, is provided as a development device for yellow color, and the development roller 132 is provided as a development device for magenta color. Moreover, the development roller 133 is provided as a development device for cyan color, and the development roller 134 is provided as a development device for cyan color. Each of the development devices develops an electrostatic latent image by use of a two-component developer consisting of toner and carriers. Four removable (interchangeable) toner cartridges associated with the four development devices are incorporated into the rotary development unit 13, along with respective toner replenishment mechanisms (an auger or the like) for replenishing the development devices with toner from the toner cartridges.

When a development color (the color of toner used for developing an electrostatic latent image) used for developing an electrostatic latent image is switched at the development position opposite the photosensitive drum 11, the rotary development unit 13 is rotated in one direction (a clockwise direction in the drawing), thereby moving the respective development rollers 131, 132, 133, 134 along the rotational pathway of the rotary development unit 13. When the electrostatic latent image on the photosensitive drum 11 is developed with yellow toner, the yellow development roller 131 is located at the development position opposite the photosensitive drum 11. When the electrostatic latent image is developed with magenta toner, the magenta development roller 132 is located at the development position. When the electrostatic latent image is developed with cyan toner, the cyan development roller 133 is located at the development position. When the electrostatic latent image is developed with black toner, the black development roller 134 is located at the development position.

The transfer unit 14 has a transfer drum 15. A sheet carrier, which is formed from a dielectric film, is stretched under tension around the outer circumference of the transfer drum 15. The transfer drum 15 is coupled to a custom-designed electric motor or a rotational drive system of the photosensitive drum 11 by means of a gear, and is rotationally driven in the direction of the arrow in the drawing (in the counterclockwise direction). Disposed around the transfer drum 15 are a transfer electrifying device 17, a separation discharger 18, a toner electric charge control electrifying device 19, a peeling claw 20, a static eliminator 21, a cleaner 22, a press roller 23, and an adsorption electrifying device 25. A sheet, which is transported from the sheet tray section 4 by way of a sheet feeding roller 4*a* and a sheet feeding guide 4*b*, awaits in a standby condition at a registration position 4*c* so as to be timed to an image (a toner image). Subsequently, the sheet is transported to the transfer drum 15 at predetermined timing, and is attracted by the dielectric film by means of corona discharge of the adsorption electrifying device 25.

The transfer drum 15 rotates in synchronism with the photosensitive drum 11. The toner image developed with yellow toner is first transferred onto the sheet wrapped around the outer circumference of the transfer drum 15, by means of the transfer electrifying device 17. The toner images of the other colors; namely, magenta, cyan, and black, are sequentially transferred (superposed) by means of rotation of the transfer drum 15. When the toner images of four colors have been transferred to the sheet by four rotations of the transfer drum 15, the sheet is subjected to AC static-elimination performed by the separation dischargers 18 provided inside and outside of the transfer drum 15. The sheet is separated by the peeling claw 20, and the thus-separated sheet is delivered to a fuser 29 by means of a transport belt 27. In the fuser 29, the toner image is fused and fixed onto the sheet by means of a hot press roller 30. Namely, when a full color image is formed, the sheet must be sequentially subjected to four development processing operations by use of the four development rollers 131 to 134. When a monochrome image is formed, the sheet undergoes only one development processing operation that uses the black development roller 134.

Figure 2A:
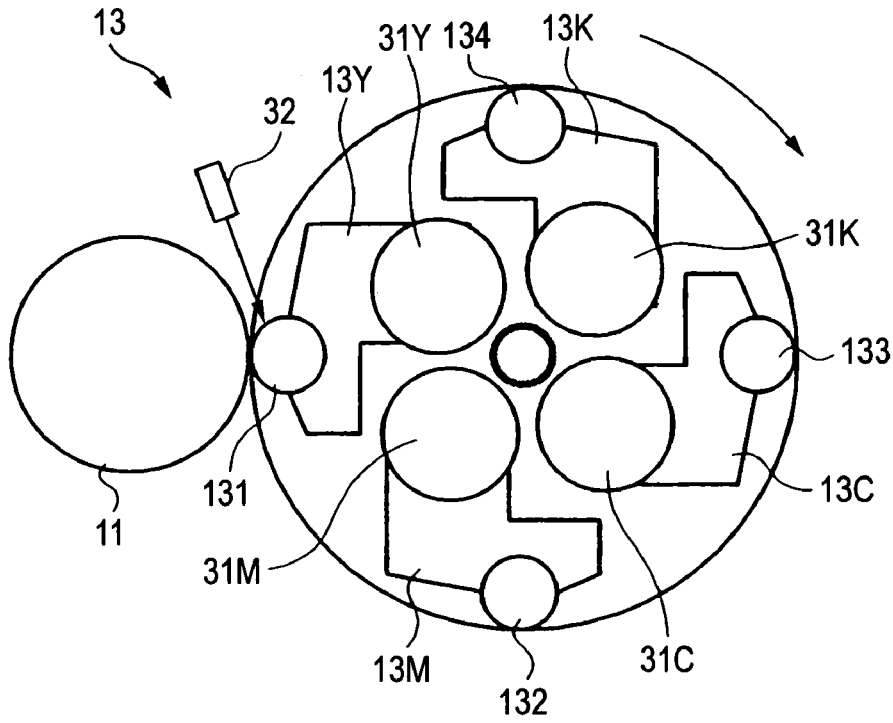
FIGS. 2A and 2B are diagrammatic views showing a positional relationship among individual sections around a rotary development unit, as the configuration of the image forming apparatus of the embodiment of the present invention.
Figure 2B:
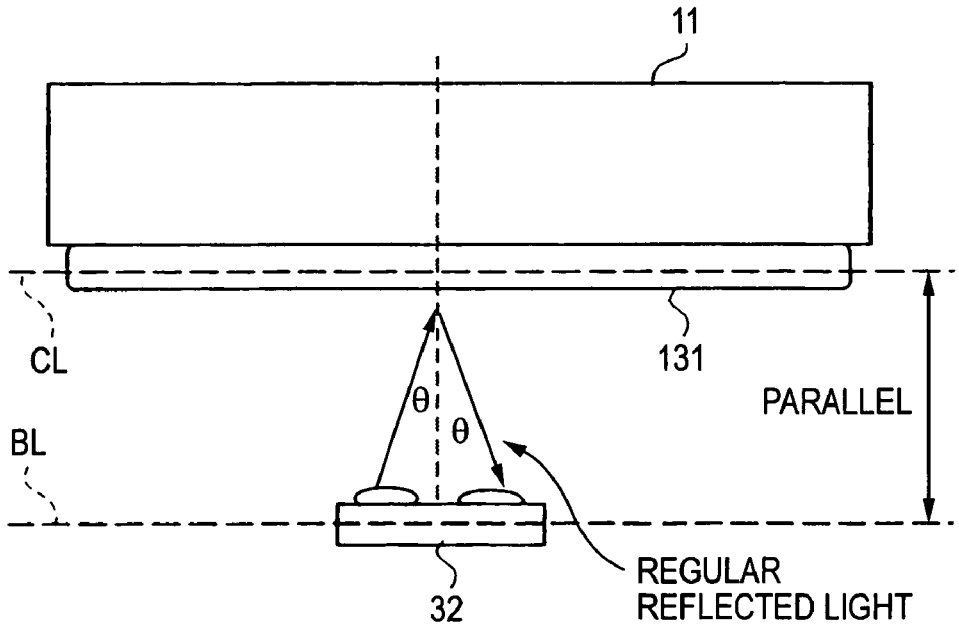

FIGS. 2A and 2B are schematic diagrams showing a positional relationship among respective sections disposed around the rotary development unit, as the configuration of the image forming apparatus according to the embodiment of the present invention. In the illustrated rotary development unit 13, the yellow development roller 131 is disposed in a development position opposing the photosensitive drum 11 so as to come into close proximity with the photosensitive drum 11. Here, the term "development position" refers to a position where there is actually performed processing for developing the electrostatic latent image formed on the photosensitive drum 11 into a toner image through use of a developer (a two-component developer) carried by the development roller. In a state where the development roller 131 is placed in this development position, a gap on the order of millimeters is ensured between the photosensitive drum 11 and the development roller 131. This gap is ensured similarly even when the other development rollers 132, 133, and 134 are arranged in the development position.

The development roller 131 is provided for a yellow development device 13Y; the development roller 132 is provided for a magenta development device 13M; the development roller 133 is provided for a cyan development device 13C; and the development roller 134 is provided for a black development device 13K. These development devices 13Y, 13M, 13C, and 13K are provided in the rotary development unit 13. A toner cartridge 31Y for storing yellow toner, a toner cartridge 31M for storing magenta toner, a toner cartridge 31C for storing cyan toner, and a toner cartridge 31K for storing black toner are removably provided in the rotary development unit 13.

A toner concentration sensor 32, which is to act as "toner concentration detection means," is disposed around the rotary development unit 13. The toner concentration sensor 32 is formed from an optical sensor having a light-emitting element and a light-receiving element. This toner concentration sensor 32 is of a reflected-light detection type to receive the light reflected from a developer by means of the light-receiving element when the developer is exposed to the light emitted from the light-emitting element (in general, infrared light). Of toner and carriers, which form the two-component developer, toner reflects light, and the carriers absorb light. Consequently, when the amount of light reflected from the developer is measured with the toner concentration sensor 32, the concentration of toner in the developer can be detected.

In the configuration adopted by the image forming apparatus according to the embodiment of the present invention, the toner concentration sensor 32 is disposed in the vicinity of the development position opposing the photosensitive drum 11, on the rotational pathway of the rotary development unit 13. The toner concentration sensor 32 detects the concentration of toner on the development rollers (in more detail, the mixing ratio of toners of the two-component developer carried over the outer circumference of the development rollers by means of magnetic force of a magnet) arranged in the development position (the position opposing the photosensitive drum 11) by means of rotation of the rotary development unit 13.

As illustrated, when the yellow development roller 131 is located in the development position, the toner concentration sensor 32 is disposed in a position, which is upwardly oblique to the yellow development roller 131, while opposing the development roller 131. The relative positional relationship between the development roller located in the development position and the toner concentration sensor 32 applies to a case where any one of the four development rollers 131, 132, 133, and 132 is situated in the development position, as well. Consequently, the mount position of the toner concentration sensor 32 is described when the development roller 131 is placed in the development position.

The toner concentration sensor 32 is disposed while directly facing the front of the development roller 131 placed in the development position so that the outer circumferential surface of the development roller 131 can be directly exposed to the light emitted from the light-emitting element of the toner concentration sensor 32. In more detail, when being placed, the toner concentration sensor 32 is arranged in such a direction that a virtual straight line BL connecting the light-emitting surface of the toner concentration sensor 32 to the light-receiving surface of the same becomes parallel to the center axis CL of the development roller 131. Even when the position of the toner concentration sensor 32 is slightly displaced in the direction parallel to the virtual straight line BL in a case where such a toner concentration sensor 32 is arranged, the detection sensitivity of the sensor is not affected. For this reason, an incidence angle θ1 of light which enters the development roller 131 from the light-emitting element of the toner concentration sensor 32 and a reflection angle θ2 of the light reflected from the development roller 131 (regular reflected light) can be adjusted to an equivalent angle during actual assembly adjustment, so long as only the orientation of the optical axis of the toner concentration sensor 32 is aligned with the center axis CL of the development roller 131 with the center of the toner concentration sensor 32 aligned to the virtual straight line BL. Therefore, the detection sensitivity of the toner concentration sensor 32 can be enhanced by means of simple assembly adjustment.

Figure 3:
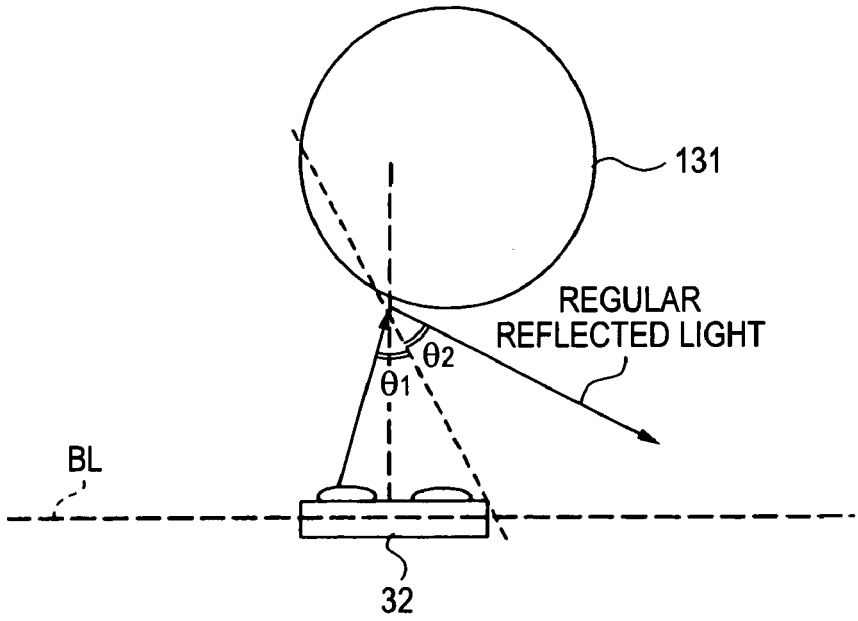
FIG. 3 is a view showing an example arrangement of a toner concentration sensor.

As shown in, e.g., FIG. 3, in a case where the toner concentration sensor 32 is arranged in such a direction that the virtual straight line BL connecting the light-emitting surface to the light-receiving surface of the toner concentration sensor 32 is oriented perpendicular to the center axis CL of the development roller 131, when the toner concentration sensor 32 is displaced in the direction parallel to the virtual straight line BL, the position (i.e., a reflection position) on the development roller 131 exposed to the sensor light is correspondingly displaced in the circumferential direction of the roller. Hence, the detection sensitivity of the sensor is greatly affected. For this reason, even when the mount position of the toner concentration sensor 32 has become slightly displaced during actual assembly adjustment, a difference arises between the incident angle θ1 and the reflection angle θ2 of light. Consequently, in order to attain high detection sensitivity, high-precision assembly adjustment must be carried out at the expense of time. When a difference has arisen between the incident angle θ1 and the reflection angle θ2 for reasons of a deficiency of adjustment, the light reflected from the outer circumferential surface of the development roller 131 (i.e., the regular reflected light) fails to efficiently reach the light-receiving surface of the toner concentration sensor 32. Hence, a drop arises in the detection sensitivity of the sensor.

Figure 4:
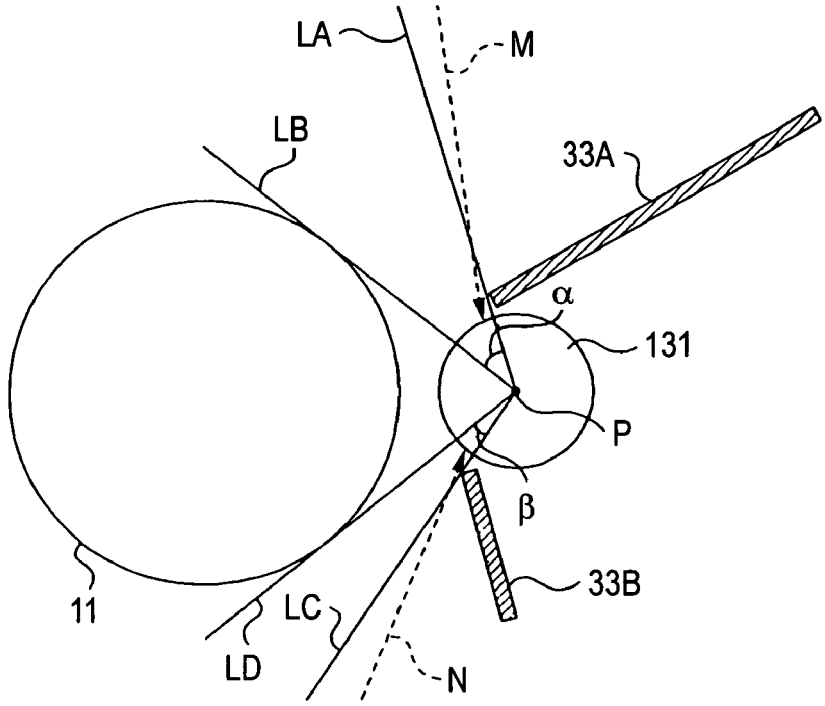
FIG. 4 is a view showing an angle at which the concentration of toner around a development roller disposed in a development position can be detected.
Figure 5:
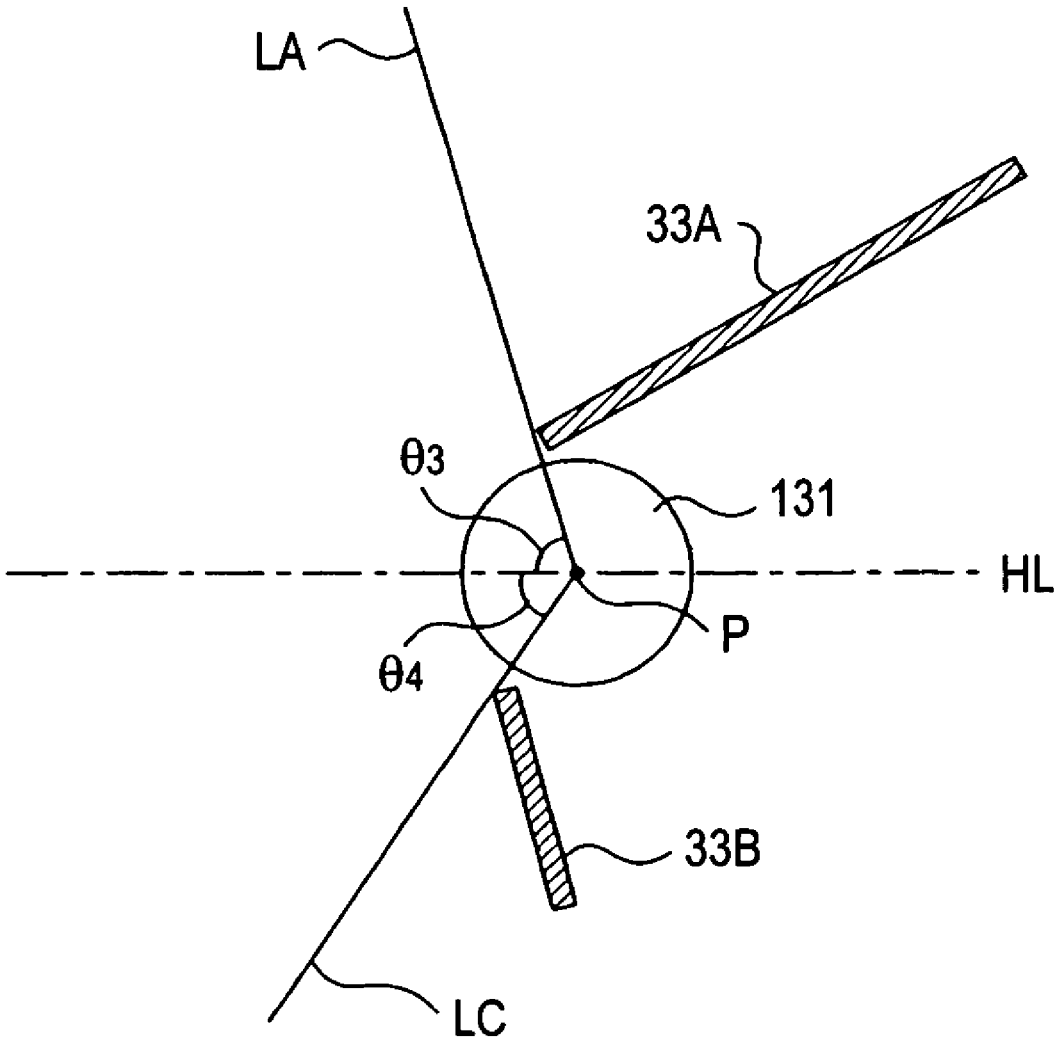
FIG. 5 is a view showing a positional relationship between a development roller and a housing.

FIG. 4 is a view showing an angle which enables detection of toner concentration around the development roller located in the development position. Here, the term "angle which enables detection of toner concentration" is an angle for defining a space where the toner concentration sensor 32 is to be placed on the occasion of the concentration of toner on the development roller being detected by use of the toner concentration toner 32. Assume that an angle which enables detection of toner concentration is defined with reference to the rotation center P of the development roller 131 with the yellow development roller 131 being placed in the development position. The reason why the rotation center P of the development roller 131 is taken as a reference is that the light (the regular reflected light) reflected from the outer circumferential surface of the development roller 131 becomes likely to be received by the light-receiving surface of the sensor by means of aligning the orientation of the optical axis of the toner concentration sensor 32 to the rotation center P of the development roller 131, whereby high sensitivity of the sensor is achieved.

An upper housing 33A and a lower housing 33B, which form a housing of the development device 31Y, are arranged around the development roller 131. Therefore, in order to detect the concentration of toner in the developer actually carried over the development roller 131 by means of the toner concentration sensor 32 while avoiding the upper and lower housings 33A and 33B, the toner concentration sensor 32 must be disposed upwardly or downwardly oblique to the development roller 131.

When the toner concentration sensor 32 is disposed upwardly oblique to the development roller 131, an angle α made between a straight line LA connecting the rotation center P of the development roller 131 to the edge of the upper housing 33A and a straight line LB connecting the rotation center P of the development roller 131 to the outer circumferential surface of the photosensitive body 11 becomes the angle which enables detection of toner concentration. When the concentration of toner on the development roller 131 is detected in a direction indicated by arrow M of broken lines in the drawing by means of the toner concentration sensor 32, a slight drop arises in the detection sensitivity of the sensor. However, there may also arise a case where the concentration of toner can be detected without involvement of occurrence of a practical problem. Consequently, the angle which enables detection of substantial toner concentration can be defined as an angle which is slightly larger than the above-described angle α.

When the toner concentration sensor 32 is disposed downwardly oblique to the development roller 131, an angle β made between a straight line LC connecting the rotation center P of the development roller 31 to the edge of the lower housing 33B and a straight line LD connecting the rotation center P of the development roller 131 to the outer circumferential surface of the photosensitive body 11 becomes an angle which enables detection of toner concentration. When the concentration of toner on the development roller 131 is detected from a direction indicated by arrow N of broken lines in the drawing by the toner concentration sensor 32, a slight drop arises in the detection sensitivity of the sensor. However, there may arise a case where toner concentration can be detected without involvement of occurrence of a practical problem. Consequently, the angle which enables detection of substantial toner concentration can be defined as an angle which is slightly larger than the above-described angle β.

When the toner concentration sensor 32 is arranged in a position higher than the development roller 131 disposed in the development position, toner that falls from the development position never adheres to the light-emitting surface or the light-receiving surface of the toner concentration sensor 32. Hence, a stain on the surface of the sensor and an associated drop in the sensitivity of the sensor can be prevented. In the housing structure of the development device, the lower housing 33B has a larger volume than does the upper housing 33A, in order to agitate the developer. Hence, the relationship between the angles which enable detection of toner concentration is defined as $\alpha>\beta$. Therefore, placing the toner concentration sensor 32 at a position higher than the development position is advantageous in terms of assurance of a space used for mounting the sensor.

In order to ensure a wide area used for detecting the concentration of toner (i.e., an area exposed to sensor light) on the development roller 131 or to ensure a space used for mounting the toner concentration sensor 32 for the purpose of lessening limitations on the mount position of the toner concentration sensor 32, it is desirable to set as large as possible an angle θ3 formed between the straight line LA connecting the rotation center P of the development roller 131 to the edge of the upper housing 33A and a horizontal axis HL passing through the rotation center P of the development roller 131 and an angle θ4 made between the straight line LC connecting the rotation center P of the development roller 131 to the edge of the lower housing 33B and the horizontal axis HL passing through the rotation center P of the development roller 131.

Figure 6:
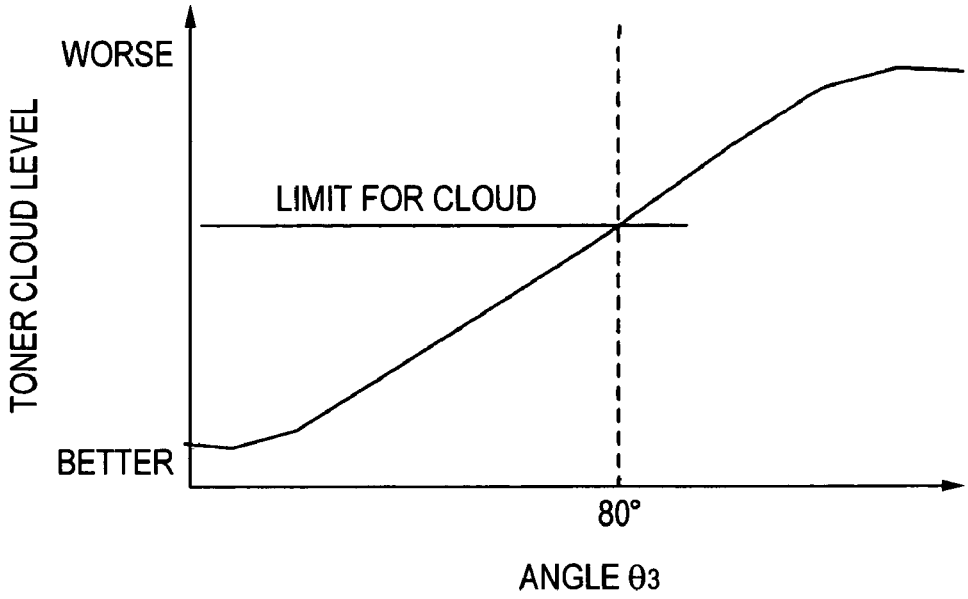
FIG. 6 is a view showing a test result of a toner cloud.

However, when the angle θ3 has become extremely large, the upper outer circumferential surface of the development roller 131 becomes greatly exposed, and hence imperfections in image quality due to a cloud of toner becomes likely to arise. Therefore, if the result of a test conducted to determine a relationship between the cloud level of toner and the angle θ3 is as shown in FIG. 6, it is desirable to set the position of the edge of the upper housing 33*a* so as to acquire a relationship of θ3≦80°. When the angle θ3 has become smaller, the angle α that enables detection of toner concentration becomes smaller correspondingly (see FIG. 4). Therefore, the lower limit value of the angle θ3 must be set to a value (preferably about 10°) which enables assurance of at least a space used for mounting the toner concentration sensor 32.

Figure 7:
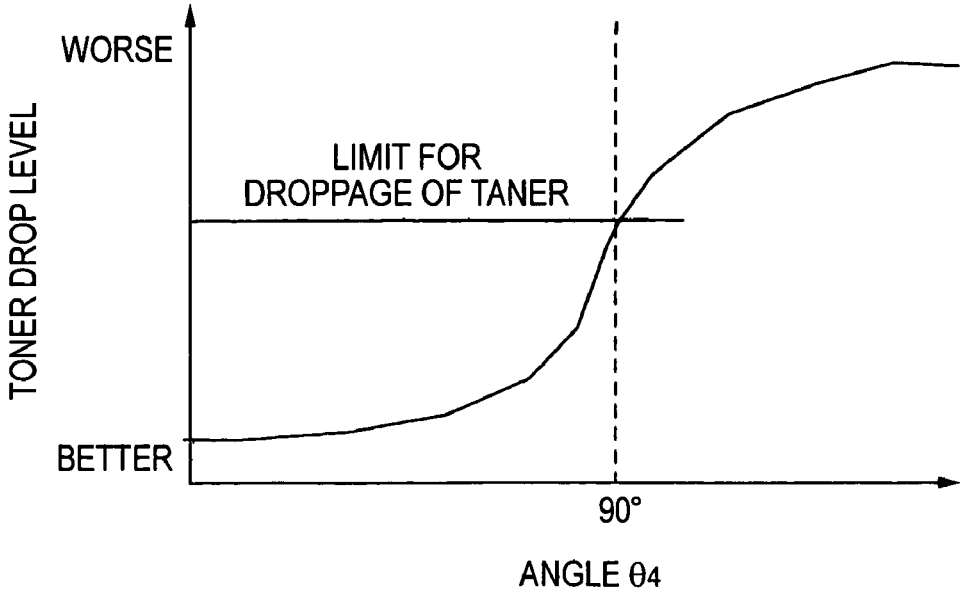
FIG. 7 is a view showing a test result of drop of toner.

When the angle θ4 has become extremely large, the lower outer circumferential surface of the development roller 131 becomes greatly exposed. Therefore, a so-called phenomenon of droppage of toner, where a portion of the toner carried over the development roller 131 peels off from the outer circumferential surface of the roller, becomes likely to arise. For this reason, if the result of a test conducted to determine a relationship between, e.g., a toner droppage level and the angle θ4, is as shown in FIG. 7, it is desirable to set the position of the edge of the lower housing 33B such that a relationship of θ4≦90° is achieved.

When the toner concentration of toner on the development roller 131 is detected by means of the toner concentration sensor 32, the toner concentration sensor 32 is disposed in the vicinity of the photosensitive drum 11. Accordingly, when the light radiated from the toner concentration sensor 32 toward the development roller 131 has undergone reflection on the outer circumferential surface of the roller, a portion of the reflected light is considered to reach the photosensitive drum 11, to thus affect the surface potential of the photosensitive drum 11. Particularly, when the electrostatic latent image formed on the photosensitive drum 11 has been affected by the reflected light, there may arise a fear of a drop arising in image quality.

Figure 8:
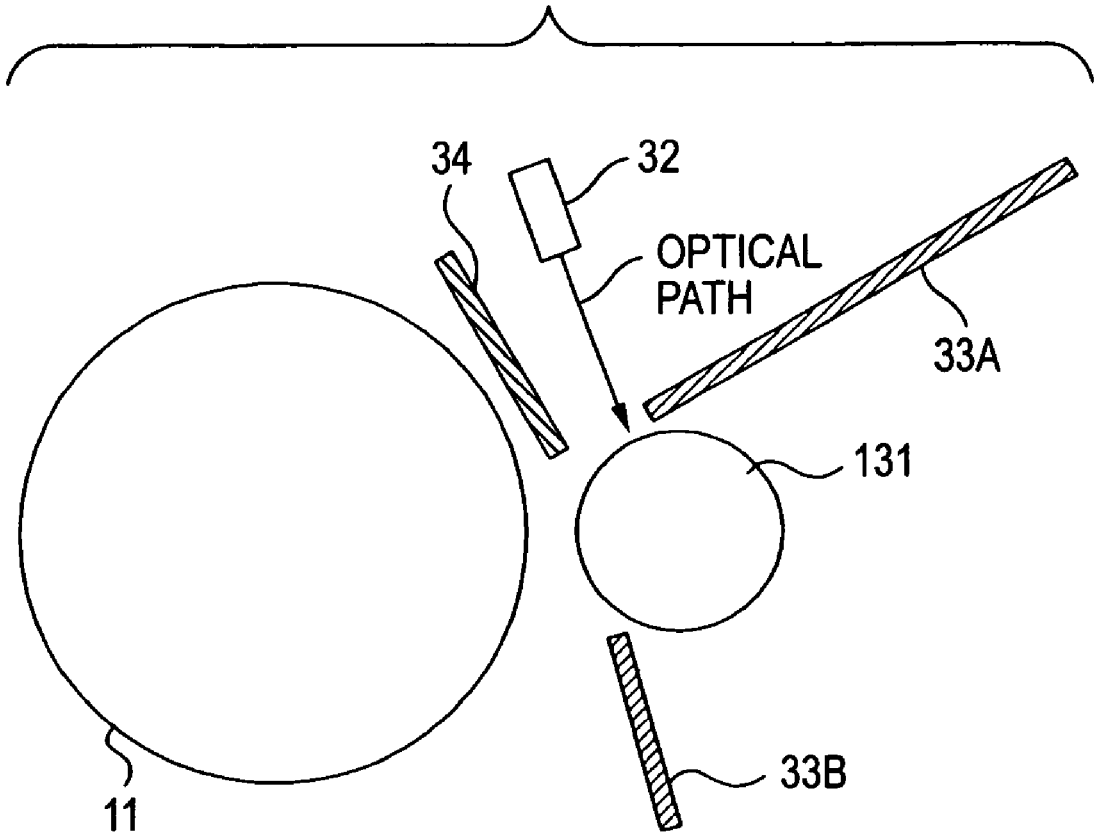
FIG. 8 is a view showing an example layout of a light-shielding member.

For this reason, as shown in FIG. 8, a light-shielding member 34 is interposed between the optical path of the toner concentration sensor 32 and the photosensitive drum 11. The light-shielding member is, e.g., a plate-like member formed from resin of a color which exhibits a high light absorption property (black and the like). The light-shielding member 34 is for blocking light by means of partitioning a space between the toner concentration sensor 32 and the photosensitive drum 11 such that the light having originated from the toner concentration sensor 32 does not leak to the photosensitive drum 11.

As a result of the light-shielding member 34 being provided as mentioned above, even when the light emitted from the toner concentration sensor 32 to the development roller 131 has been reflected from the outer circumferential surface of the roller and when a portion of the reflected light has traveled toward the photosensitive drum 11, the light traveling toward the photosensitive drum 11 is blocked by the light-shielding member 34 before reaching the photosensitive drum 11. Therefore, the electrostatic latent image formed on the photosensitive drum 11 becomes hardly susceptible to the influence of by the light reflected from the development roller 131. Consequently, occurrence of a drop in image quality, which would otherwise be caused by influence of the reflected light, can be effectively prevented.

When the light-shielding member 34 is not provided, timing at which the toner concentration is detected by the toner concentration sensor 32 is set in a period during which an electrostatic latent image is not present on the surface of the drum exposed to a portion of the light reflected from the development roller 131 in the rotating direction of the photosensitive drum 11, thereby effectively preventing a drop in image quality, which would otherwise be caused by influence of reflected light (although the light on a non-image area of the photosensitive drum is deteriorated in proportion to the intensity of the reflected light).

Figure 9:
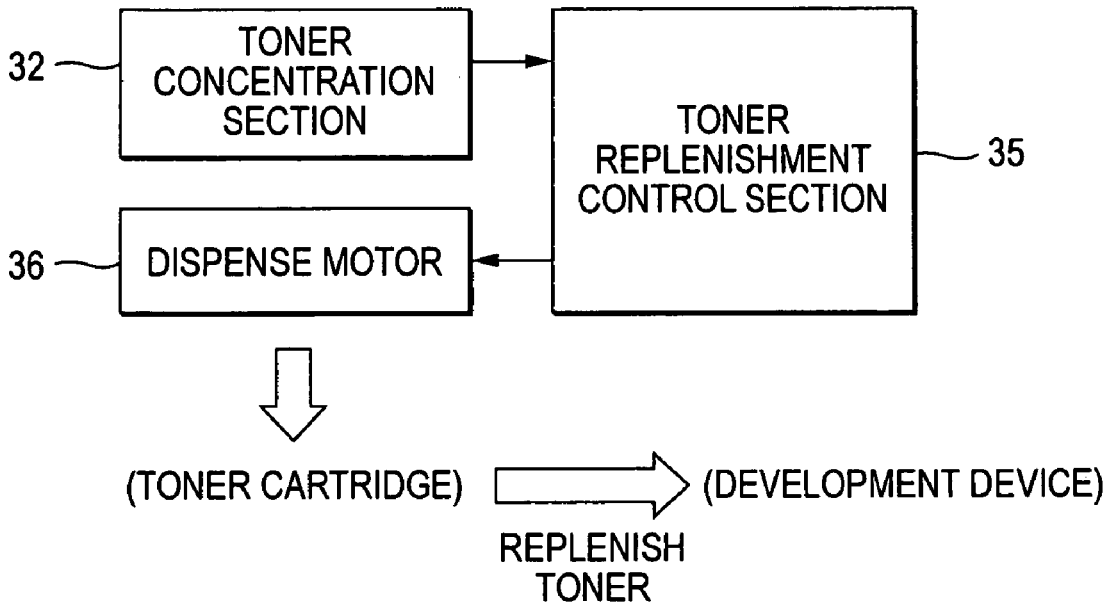
FIG. 9 is a block diagram showing an example configuration of a toner concentration control system.

FIG. 9 is a block diagram showing an example configuration of a toner concentration control system. In the drawing, a toner concentration control section 35 is electrically connected to the toner concentration sensor 32 and a dispense motor 36. The toner concentration sensor 32 detects toner concentration upon receipt of an instruction for executing detection of toner concentration from the toner concentration control section 35, and outputs the result of detection to the toner concentration control section 35. On the basis of the result of detection of toner concentration output from the toner concentration sensor 32, the toner concentration control section 35 controls driving of the dispense motor 36. Specifically, when the toner concentration detected by the toner concentration sensor 32 falls within a preset allowable range, the dispense motor 36 is not rotationally driven. When the toner concentration detected by the toner concentration sensor 32 is less than a lower limit value within the allowable range, the dispense motor 36 is controlled so as to be rotationally driven for only a predetermined drive time.

The dispense motor 36 is to become a drive source of a toner replenishing mechanism (not shown) for replenishing the development device with toner from a toner cartridge. Consequently, when the toner concentration control section 35 has rotationally driven the dispense motor 36, the amount of toner that is essentially proportional to the drive time is supplied from the toner cartridge to the development device. Since the present invention relates to a so-called rotary development units, replenishment of the development device with toner from the toner cartridge can be performed only when the development roller of the development apparatus is located in the development position.

Operation of the image forming apparatus performed when toner concentration is detected by use of the toner concentration sensor will now be described.

First, when a full color image is formed by the image forming apparatus, the rotary development unit 13 is rotated appropriately during formation of an image. The yellow development roller 131, the magenta development roller 132, the cyan development roller 133, and the black development roller 134 are sequentially moved to the development position opposing the photosensitive drum 11, to thus switch a development color. The switching sequence of a development color is not limited to the sequence described herein, and switching of the development color can also be performed in another sequence.

Provided that the yellow development roller 131 is moved to the development position by rotation of the rotary development unit 13, rotation of the development roller 131 is commenced at a point in time when the development roller 131 has reached the development position (a point in time when rotation of the rotary development unit 13 has stopped). Subsequently, after the development roller 131 has performed developing operation, the rotary development unit 13 resumes rotation, whereby the development roller 131 departs from the development position, so that rotation of the development roller 131 is stopped concurrently. Specifically, the development roller 131 rotates only when being located in the development position. Further, during a period in which the development roller is located in the development position (a period during which rotation of the rotary development unit 13 is halted), the development roller 131 is rotating at all times.

Accordingly, on the assumption that a period of time during which the development roller 131 is located in the development position and the development roller 131 is rotating is defined as a "development cycle period," the above-described toner replenishment control section 35 controls driving operation of the dispense motor 36 on the basis of the detection result generated by the toner concentration sensor 32, to thus control replenishment of the development device with toner from the toner cartridge.

The electrostatic latent image for yellow development purpose formed on the photosensitive drum 11 passes by the position opposing the development roller 131 in association with rotation of the photosensitive drum 11 within the development cycle period during which the development roller 131 is situated at the development position, whereupon the electrostatic latent image is developed with yellow toner supplied from the development roller 131. At that time, the electrostatic latent image on the photosensitive drum 11 does not oppose the development roller 131 at all times from start timing of the development cycle period until the end timing of the same. After lapse of a predetermined period of time after the start timing of the development cycle period, the front edge (the first line) of the electrostatic latent image arrives at the position opposing the development roller 131. Subsequently, the rear end (the final line) of the electrostatic latent image passes through the position opposing the development roller 131 near the end timing of the development cycle period.

At that time, on the assumption that a period during which a predetermined period of time elapses from the start timing of the development cycle period is defined as a "development preparation period," the toner replenishment control section 35 imparts a toner concentration detection execution instruction to the toner concentration sensor 32 such that the toner concentration sensor 32 detects the concentration of toner on the development roller 131 during this development preparation period; namely, at timing when the electrostatic latent image carried by the photosensitive drum 11 does not oppose the development roller 131 (hereinafter called "non-development timing"). As a result of the concentration of toner on the development roller 131 being detected by the toner concentration sensor 32 at the non-development timing as mentioned previously, the concentration of toner on the development roller 131 can be accurately detected without being affected by variations in the concentration of toner on the development roller that is in the course of development.

When the electrostatic latent image of a patch and the electrostatic latent image of an image are formed side by side on the outer circumferential surface of the photosensitive drum 11, a development interval period, during which development is substantially interrupted from the time the electrostatic latent image of the patch has passed by the position opposing the development roller 131 until the time the electrostatic latent image of the image passes by the position within the period of the development cycle, within the development cycle period. Therefore, even when the concentration of toner on the development roller 131 has been detected by the toner concentration sensor 32 during this development interval period (i.e., at non-development timing), the concentration of toner on the development roller 131 can be accurately detected in the same manner as mentioned above.

The toner concentration 32 is for detecting the concentration of toner on the development roller disposed at the development position. Even when the other development rollers 132, 133, and 134 are sequentially arranged at the development position by means of rotation of the rotary development unit 13, the toner concentration sensor 32 detects the concentration of toner on the development roller at non-development timing in the development cycle period in the same manner as mentioned previously, so that an advantage similar to that mentioned above is yielded.

Further, the concentration of toner on the development roller disposed at the development position is detected by the toner concentration sensor 32, and the toner replenishment control section 35 controls replenishment of the development device with toner from the toner cartridge on the basis of the result of detection, by means of driving the dispense motor 36, so that replenishment of toner can be controlled in real time during the development cycle period. When the concentration of toner detected by the toner concentration sensor 32 has fallen below the allowable range, the development device can be quickly replenished with toner from the toner cartridge with quick responsiveness without involvement of occurrence of a time lag (delay). Therefore, the concentration of toner can be maintained stably at an intended concentration level.

When a full color image is formed, the respective development rollers 131, 132, 133, and 134 are sequentially (commonly) arranged at the development position where the concentration of toner is detected by the toner concentration sensor 32. Hence, for instance, even when the angles at which the respective development rollers 131, 132, 133, and 134 are arranged on the rotational pathway of the rotary development unit 13 are not uniform (at intervals of 90°), the concentration of toner of the respective development rollers 131, 132, 133, and 134 can be detected by means of one toner concentration sensor 32 without making the rotation control algorithm of the rotary development unit 13 complicated. Therefore, replenishment of toner can be controlled with the minimum number of toner concentration sensors 32 without regard to the angle required when the respective development rollers 131, 132, 133, and 134 are arranged in the rotational path of the rotary development unit 13.

Figure 10:
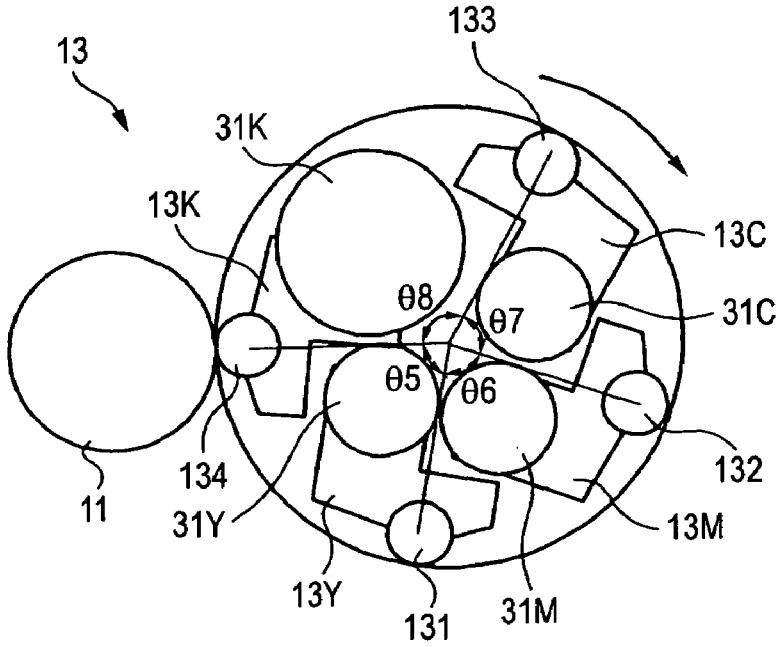
FIG. 10 is a view showing another example configuration of the rotary development unit.

The following is a conceivable specific case where the four development rollers 131, 132, 133, and 134 are not arranged at uniform angles (intervals of 90°) along the rotational pathway of the rotary development unit 13. As shown in FIG. 10, because the black toner cartridge 31K expected to be used most frequently during formation of an image is made larger (in volume) than the toner cartridges of other colors 31Y, 31M, and 31C, an angular interval θ5 between the black development roller 134 and the yellow development roller 131, an angular interval θ6 between the yellow development roller 131 and the magenta development roller 132, and an angular interval θ7 between the magenta development roller 132 and the cyan development roller 133 are set to a uniform interval of less than 90°. An angular interval θ8 between the cyan development roller 133 and the black development roller 134 is set to an angle of 90°-plus (e.g., a case where setting is effected so that θ5=θ6=θ7=80° and θ8=120°).

Figure 11:
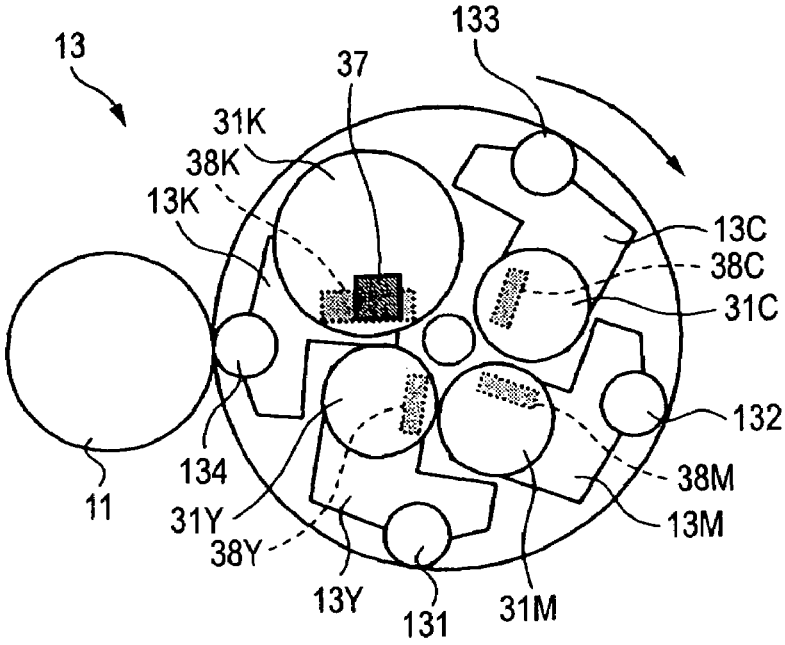
FIG. 11 is a view showing an example configuration for sensing the amount of remaining toner.

As shown in FIG. 11, the rotary development unit 13 using the toner cartridges is provided with a sensor 37 for detecting the amount of remaining toner stored in a toner cartridge (hereinafter called a "toner level detection sensor"). The toner level detection sensor 37 is a reflection-type optical sensor having a light-emitting element and a light-receiving element. When the amount of toner remaining in a toner cartridge is detected by use of the toner level detection sensor 37, a sensor detection window 38K is provided in a side surface of the toner cartridge 31K; a sensor detection window 38Y is provided in a side surface of the toner cartridge 31Y; a sensor detection window 38M is provided in a side surface of the toner cartridge 31M; and a sensor detection window 38C is provided in a side surface of the toner cartridge 31C. The sensor detection windows 38K, 38Y, 38M, and 38C are formed from a thin plate made of resin or glass which permits transmission of light (infrared light or the like) emitted from the toner level detection sensor 37.

In a state where the black development roller 134 is located at the development position, the sensor detection window 38K of the toner cartridge 31K is located at a lower portion of the side surface of the toner cartridge 31K, and the toner level detection sensor 37 is disposed so as to oppose the sensor detection window 38K. In this case, a positional relationship among the rotation center of the rotary development unit 13, the black development roller 134, and the sensor detection window 38K of the toner cartridge 31K is analogous to a positional relationship among the rotation center of the rotary development unit 13, the yellow development roller 131, and the sensor detection window 38Y of the toner cartridge 31Y, a positional relationship among the rotation center of the rotary development unit 13, the magenta development roller 132, and the sensor detection window 38M of the toner cartridge 31M, and a positional relationship among the rotation center of the rotary development unit 13, the cyan development roller 133, and the sensor detection window 38C of the toner cartridge 31C.

Consequently, in a state where the yellow development roller 131 is disposed at the development position, the sensor detection window 31Y of the toner cartridge 31Y is located at a lower portion of the side surface of the toner cartridge 31Y, and the toner level detection sensor 37 is located so as to oppose the sensor detection window 38Y. Similarly, in a state where the magenta development roller 132 is located at the development position, the sensor detection window 38M of the toner cartridge 31M is located at a lower portion of the toner cartridge 31M, and the toner level detection sensor 37 is located so as to oppose the sensor window 38M. In the state where the cyan development roller 133 is located at the development position, the sensor detection window 38C of the toner cartridge 31C is located at a lower portion of the side surface of the toner cartridge 31C, and the toner level detection sensor 37 is located so as to oppose the sensor detection window 38C.

Thereby, when the development roller 131 is arranged at the development position and development is being performed with yellow toner, the amount of toner remaining in the toner cartridge 31Y that stores yellow toner can be detected by means of the toner level detection sensor 37. When development is being performed with magenta toner with the development roller 132 being located at the development position, the amount of toner remaining in the toner cartridge 31M that stores magenta toner can be detected by means of the toner level detection sensor 37. Similarly, when development is being performed with cyan toner while the development roller 133 is located at the development position, the amount of toner remaining in the toner cartridge 31C that stores cyan toner can be detected by means of the toner level detection sensor 37. When the development roller 134 is placed at the development position and development is being performed with black toner, the amount of toner remaining in the toner cartridge 31K that stores black toner can be detected by means of the toner level detection sensor 37.

Consequently, the amounts of toner remaining in all the toner cartridges 31K, 31Y, 31M, and 31C can be detected by means of one toner level detection sensor. Moreover, even when the respective development rollers 131, 132, 133, and 134 are not disposed at uniform angles along the rotational pathway of the rotary development unit 13, the amount of toner remaining in each of the toner cartridges 31K, 31Y, 31M, and 31C can be detected by a basic operation algorithm of the respective development rollers 131, 132, 133, and 134 sequentially moving to the development position.

Consequently, when the development roller 131 is disposed at the development position, operation for detecting the concentration of toner on the development roller 131 by means of the toner concentration sensor 32 and operation for detecting the concentration of toner in the toner cartridge 31Y by means of the toner level detection sensor 37 can be carried out simultaneously. Moreover, when the development roller 132 is located at the development position, operation for detecting the concentration of toner on the development roller 132 by means of the toner concentration sensor 32 and operation for detecting the amount of toner remaining in the toner cartridge 31M by means of the toner level detection sensor 37 can be carried out simultaneously.

Similarly, when the development roller 133 is located at the development position, operation for detecting the concentration of toner on the development roller 133 by means of the toner concentration sensor 32 and operation for detecting the amount of toner remaining in the toner cartridge 31C by means of the toner level detection sensor 37 can be carried out simultaneously. Moreover, when the development roller 134 is located at the development position, operation for detecting the concentration of toner on the development roller 134 by means of the toner concentration sensor 32 and operation for detecting the amount of toner remaining in the toner cartridge 31K by means of the toner level detection sensor 37 can be carried out simultaneously.

When the sensor surfaces (the light-emitting surface and the light-receiving surface) of the toner concentration sensor 32 are stained as a result of adhesion of toner or dust, the detection sensitivity of the sensor drops. Particularly, when the toner concentration sensor 32 is arranged in the vicinity of the development position, the sensor surfaces of the toner concentration sensor 32 are likely to be stained as a result of adhesion of toner. For this reason, in the present embodiment, there is provided a shutter mechanism for opening or closing the sensor surfaces of the toner concentration sensor 32. When any one of the development rollers is located at the development position, the shutter mechanism opens the sensor surfaces of the toner concentration sensor 32, to thus enable detection of toner concentration. When none of the development rollers is located at the development position, the shutter mechanism closes so as to cover the sensor surfaces of the toner concentration sensor 32, to thus prevent adhesion of toner or dust. Such opening and closing operations of the shutter can be performed through use of a solenoid or the like. If a drive source specifically designed for the shutter mechanism is provided, a cost-related disadvantage becomes greater.

Figure 12A:
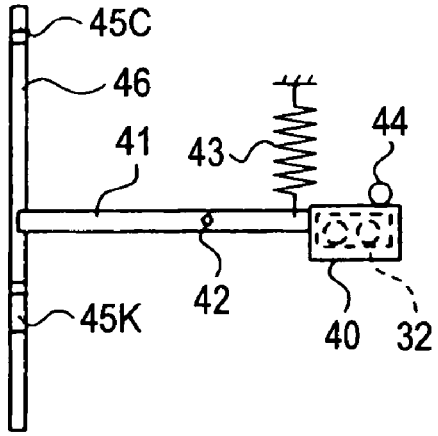
FIGS. 12A-12C are views for describing the configuration and operation of a shutter mechanism.
Figure 12B:
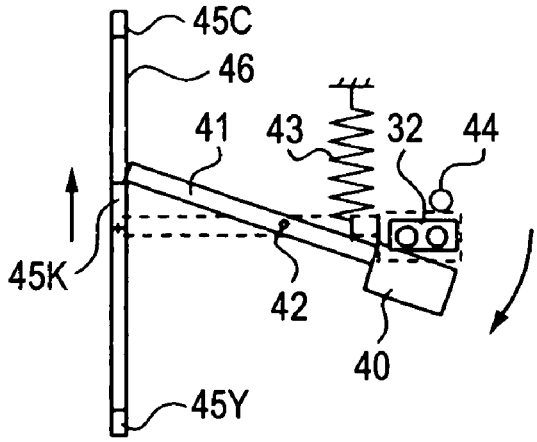
Figure 12C:
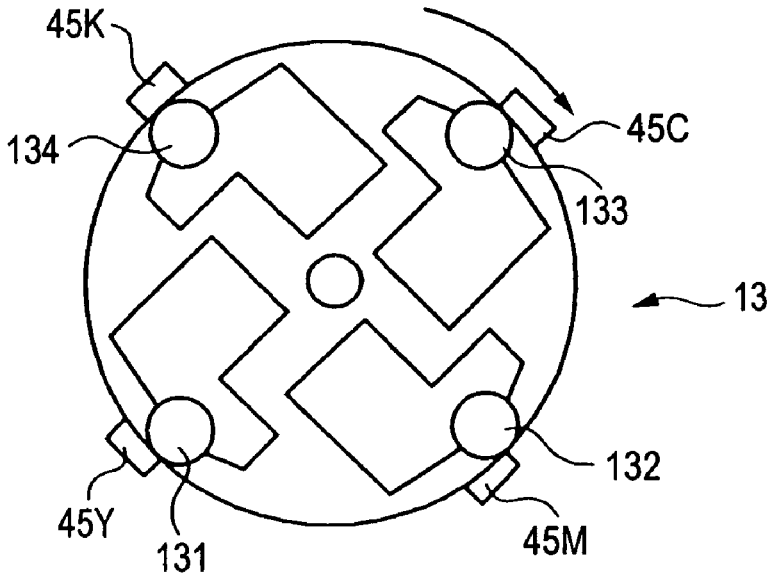

The present embodiment adopts a mechanism for opening and closing the shutter by utilization of rotation of the rotary development unit 13. FIGS. 12A to 12C are views for describing the specific configuration and operation of the shutter mechanism. In the drawings, a shutter member 40 is a plate-like member which is larger than the sensor surfaces of the toner concentration sensor 32, and the shutter member 40 is attached to one end of a shutter rod 41. A longitudinal intermediate portion of the shutter rod 41 is rotationally supported by a rotary shaft 42. As shown in FIG. 12A, the shutter rod 41 is supported in a horizontal orientation as a result of the shutter member 40 colliding against a stopper member 44 while undergoing counterclockwise rotational force around the rotary shaft 42 under restoration force (tensile force) of a coil spring 43 latched to the neighborhood of the shutter member 40. In this supported state, the shutter member 40 is retained in a closed state so as to cover the sensor surfaces of the toner concentration sensor 32.

The other end of the shutter rod 41 is located at a position along the rotational pathway of the rotary development unit 13, where the other end contacts four protrusions 45K, 45Y, 45M, and 45C radially protruding from the outer circumferential portion of the rotary development unit 13. The respective protrusions 45K, 45Y, 45M, and 45C are provided on a rotary plate 46 which rotates in conjunction with the rotary development unit 13. Moreover, when the rotary plate 46 has rotated in conjunction with the rotary development unit 13, the respective protrusions 45K, 45Y, 45M, and 45C sequentially collide with the shutter rod 41 during the course of rotation of the rotary plate 46. As a result, the shutter rod 41 is pushed by the protrusion that collides with the shutter rod, to thus rotate clockwise as shown in FIG. 12B. In association with rotation of the shutter rod, the shutter member 40 is moved to a position where the shutter member comes off from the sensor surfaces of the toner concentration sensor 32. Therefore, the sensor surfaces of the toner concentration sensor 32 become opened.

In more detail, the protrusion 45Y comes into collision with the other end of the shutter rod 41 when the yellow development roller 131 is located at the development position. As a result of the shutter rod 41 being rotated clockwise in defiance of the restoration force of the coil spring 43, the shutter member 40 is displaced from the sensor surfaces of the toner concentration sensor 32, to thus open the sensor surfaces. Moreover, when the magenta development roller 132 is placed at the development position, the protrusion 45M comes into contact with the other end of the shutter rod 41, to thus rotate the shutter rod 41 clockwise in defiance of the restoration force of the coil spring 43. As a result, the shutter member 40 is displaced from the sensor surfaces of the toner concentration sensor 32, to thus open the sensor surfaces.

Similarly, the protrusion 45C comes into contact with the other end of the shutter rod 41 when the cyan development roller 133 is placed at the development position, to thus rotate the shutter rod 41 clockwise in defiance of the restoration force of the coil spring 43. As a result, the shutter member 40 is displaced from the sensor surfaces of the toner concentration sensor 32, to thus open the sensor surfaces. Further, the protrusion 45K comes into contact with the other end of the shutter rod 41 when the black development roller 134 is placed at the development position, to thus rotate the shutter rod 41 clockwise in defiance of the restoration force of the coil spring 43. As a result, the shutter member 40 is displaced from the sensor surfaces of the toner concentration sensor 32, to thus open the sensor surfaces.

By means of provision of such a shutter mechanism, the sensor surfaces of the toner concentration sensor 32 are opened only when the respective development rollers 131, 132, 133, and 134 are placed at the development position to thus detect toner concentration. At other times, the sensor surfaces of the toner concentration sensor 32 are covered with the shutter member 40, and hence stains on the sensor surfaces caused as a result of adhesion of toner or dust can be lessened. Moreover, the shutter is opened or closed by utilization of rotation of the rotary development unit 13, and therefore a drive source, such as a solenoid, does not need to be provided separately. For these reasons, the present invention can be implemented at low cost. In addition, occurrence of an operation failure, which would otherwise be caused by a fault of a solenoid or the like, can be avoided.

Further, so long as a cleaning member, such as a cleaning brush or pad, is provided, as the configuration of the shutter member 40, on the surface of the shutter member 40 opposing the sensor surfaces of the toner concentration sensor 32, the sensor surfaces of the toner concentration sensor 32 can be cleaned with the cleaning member every time the shutter is opened and closed. Consequently, the sensor surfaces of the toner concentration sensor 32 can be maintained in a clean state at all times. Therefore, the detection sensitivity of the toner concentration sensor 32 can be maintained high over a long period of time.

As described above, according to an embodiment of the invention, an image forming apparatus includes: an image carrier on which an electrostatic latent image is to be formed; a rotary development unit having a plurality of developer carriers that carry a developer used for developing the electrostatic latent image, the developer including toner, the plurality of the developer carriers being sequentially moved to a development position opposing to the image carrier, to switch a development color; and a toner concentration detection unit that detects the concentration of toner of the developer carried by one of the developer carriers located at the development position.

According to another aspect of the invention, the image forming apparatus further includes a toner replenishment control unit; wherein the rotary development unit has a plurality of development devices and a plurality of toner cartridges, each associated with each of the plurality of developer carriers; the toner replenishment control unit controls toner-replenishment of each of the development devices from the associated toner cartridge based on a result of detection by the toner concentration detection unit; and the toner replenishment control unit controls the replenishment of toner when the target developer carrier of the toner concentration detection unit is positioned at the development position.

According to another aspect of the invention, the toner concentration detection unit is disposed at a position higher than the development position.

According to another aspect of the invention, the toner concentration detection unit detects the concentration of toner on the developer carrier at a timing when the developer carrier is positioned at the development position and when the electrostatic latent image formed on the image carrier does not oppose the developer carrier.

According to another aspect of the invention, the image forming apparatus further includes a light-shield member; wherein the toner concentration detection unit includes an optical sensor having a light-emitting element and a light-receiving element; and the light-shielding member is interposed between the image carrier and an optical path of the toner concentration detection unit.

According to the embodiment of the present invention, the concentration of toner on the developer carrier disposed at the development position is detected by the toner concentration detection means. Hence, while the developer carrier is disposed at the development position, replenishment of the development device with toner from the toner cartridge may be controlled in real time on the basis of the result of detection performed by the toner concentration detection unit.

The entire disclosure of Japanese Patent Application No. 2005-254658 filed on Sep. 2, 2005 including specification, claims, drawings and abstract is incorporated herein by reference in its entirety.

What is claimed is:

1. An image forming apparatus, comprising:

an image carrier on which an electrostatic latent image is to be formed;

a rotary development unit having a plurality of developer carriers that carry a developer used for developing the electrostatic latent image, the developer including toner, the plurality of the developer carriers moving to a development position opposing to the image carrier; and a toner concentration detection unit that detects the concentration of toner in the developer carried by one of the developer carriers located at the development position.

2. The image forming apparatus according to claim 1, further comprising a toner replenishment control unit, wherein the rotary development unit has a plurality of development devices and a plurality of toner cartridges, each associated with each of the plurality of developer carriers;

the toner replenishment control unit controls toner-replenishment of each of the development devices from the associated toner cartridge based on a result of detection by the toner concentration detection unit; and the toner replenishment control unit controls the replenishment of toner when the target developer carrier of the toner concentration detection unit is positioned at the development position.

3. The image forming apparatus according to claim 1, wherein the toner concentration detection unit is disposed at a position higher than the development position.

4. The image forming apparatus according to claim 1, wherein the toner concentration detection unit detects the concentration of toner on the developer carrier at a timing when the developer carrier is positioned at the development position and when the electrostatic latent image formed on the image carrier does not oppose the developer carrier.

5. The image forming apparatus according to claim 1, further comprising a light-shield member, wherein the toner concentration detection unit includes an optical sensor having a light-emitting element and a light-receiving element; and the light-shielding member is interposed between the image carrier and an optical path of the toner concentration detection unit.

6. The image forming apparatus according to claim 1, wherein the toner concentration detection unit is disposed in the vicinity of the development position.

7. The image forming apparatus according to claim 1, wherein the toner concentration detection unit exposes light onto the development position.

* * * * *